US005244200A

United States Patent [19]

Manzke

[11] Patent Number: 5,244,200

[45] Date of Patent: Sep. 14, 1993

[54] RETRACTABLE-RAMP ACCUMULATOR AND METHOD

[75] Inventor: G. William Manzke, Quakerstown, Pa.

[73] Assignee: Bell & Howell Phillipsburg Company, Allentown, Pa.

[21] Appl. No.: 931,617

[22] Filed: Aug. 18, 1992

[51] Int. Cl.[5] ..... B65H 43/04; B65H 31/08

[52] U.S. Cl. ..... 271/198; 271/212; 271/213; 271/220

[58] Field of Search ..... 271/184, 188, 198, 209, 271/212, 213, 220

[56] References Cited

U.S. PATENT DOCUMENTS

| | | | |
|---|---|---|---|
| 4,640,506 | 2/1987 | Luperti et al. . | |
| 4,799,663 | 1/1989 | Golicz . | |
| 4,805,891 | 2/1989 | Luperti et al. . | |
| 4,808,054 | 2/1989 | Cuzin | 271/212 X |
| 4,925,180 | 5/1990 | Golicz . | |
| 4,925,362 | 5/1990 | Golicz . | |
| 5,094,443 | 3/1992 | Young, Jr. | 271/198 X |
| 5,123,639 | 6/1992 | Edwards | 271/198 X |
| 5,147,092 | 9/1992 | Driscoll et al. | 271/188 X |

FOREIGN PATENT DOCUMENTS

| | | | |
|---|---|---|---|
| 2316628 | 10/1974 | Fed. Rep. of Germany | 271/212 |

*Primary Examiner*—Robert P. Olszewski
*Assistant Examiner*—Boris Milef
*Attorney, Agent, or Firm*—Millen, White, Zelano & Branigan

[57] ABSTRACT

A retractable-ramp accumulator comprises driven endless elastic belts to feed sheets therebetween along a sheet-feeding path, a sheet stacker having a stacking location and including a selectively releasable stop gate, and at least one selectively retractable ramp for selectively deflecting sheets out of the sheet feeding path for selectively feeding under or over previous sheets that are stopped in the stacking location by the stop gate. In one embodiment, an upper and a lower set of ramps are arranged such that while one set of ramps is retracted, the other set of ramps is interposed in the sheet feeding path, so that sheets can be selectively "over" or "under" accumulated.

8 Claims, 3 Drawing Sheets

RETRACTABLE-RAMP ACCUMULATOR AND METHOD

BACKGROUND OF THE INVENTION

1. Field of the Invention

This invention relates generally to sheet accumulators and more particularly to an improved accumulator mechanism and an improved method for selectively "under" or "over" accumulating into stacks or passing-through seriatim-fed sheets, the accumulator employing selectively retractable ramp means.

2. Prior Art and Other Considerations

Various accumulators have been employed for accumulation into stacks of sheet material such as paper sheets, documents, and the like. Such uses particularly occur during preparation and processing of mailable articles when a plurality of sheets needs to be assembled into a packet for further handling that may include additional collating, folding, inserting, etc.

For instance, Luperti et al discloses in U.S. Pat. No. 4,805,891 a standard and reverse collator for stacking sheets of paper fed in seriatim thereto from a singulating feeder in the same or reverse order as the sheets appear in the singulating feeder. Sheets are fed between moving endless, elastic belts, ride over a ramp guide, and are thusly delivered over or under prior sheets that have been stopped against a registration device. Adjustment of the location of the ramp guide provides for delivery over or under prior sheets. The registration device is movable to release an accumulated stack of sheets for farther transport after a desired number of sheets has accumulated. Another example of an accumulator that relies on a ramp guide mechanism is disclosed by Golicz in U.S. Pat. Nos. 4,799,663; 4,925,362; and 4,925,180. Reference is made also to co-pending U.S. patent application Ser. No. 746,622 (now U.S. Pat. No. 5,147,092), commonly assigned herewith and entitled "Roller-Accumulator for Sheets".

Whereas prior art accumulators are in many ways not unsatisfactory, high-volume sheet processing imposes requirements upon flexibility and speed of adaptability of the equipment to vary some of its functions. Such variability includes quick and easy adaptability to optionally "over" or "under" accumulate and to optionally pass-through sheets without accumulation into stacks. The retractable-ramp accumulator of the present invention provides such variability.

Accordingly, an important overall feature of the invention is the provision of an improved accumulator and an improved method for the accumulation into stacks of a number of seriatim-fed sheets. The improvements include quick and easy adaptability to optionally "over" or "under" accumulate and to optionally pass-through sheets without accumulation into stacks.

SUMMARY OF THE INVENTION

In accordance with principles of the present invention, a retractable-ramp accumulator is provided for selectively accumulating into stacks or passing-through seriatim-fed sheets, the accumulator employing selectively retractable ramp means.

The retractable-ramp accumulator mechanism feeds sheets in seriatim between moving elastic belts toward and past retractable ramp means in a sheet feeding plane. When adjusted to a first position, at least one ramp of the retractable ramp means that is interposed in the sheet feeding path intercepts sheets fed therealong, and deflects the sheets out of the sheet feeding plane. Deflected sheets are resiliently urged back toward the sheet feeding plane by the action of the moving belts. Deflected sheets continue to be fed past the ramp to a stacking location where they are stopped against a selectively-releasable stop gate. By virtue of the effected deflection, consecutive sheets are accumulated and stacked over or under prior sheets disposed and stopped in the stacking location and thusly form a stack therein. Subsequent release of the stop gate (upon accumulation of a predetermined number of sheets) releases the accumulated stack and allows it to be transported to further equipment.

When adjusted to a second position, the ramp is retracted away from the sheet feeding plane such that sheets feed past the ramp without being intercepted or deflected thereby. Depending on the state of the stop gate, an individual sheet can be temporarily stopped in the stacking location or the sheet can be allowed to continue to be transported to further equipment.

The retractable-amp accumulator comprises an upper and a lower set of driven, endless, elastic belts to feed sheets therebetween along a sheet-feeding path, selectively retractable ramp means disposed along the sheet feeding path. Downstream from the ramp means further along the sheet feeding path, a sheet stacking location is provided with a selectively-releasable stop gate.

In one embodiment of the invention, the retractable ramp means comprises an upper and a lower set of ramps (each set having at least one ramp) arranged such that while one set of ramps is retracted, the other set of ramps is interposed in the sheet feeding path, so that sheets are selectively "over" or "under" accumulated.

BRIEF DESCRIPTION OF THE DRAWINGS

The foregoing and other objects, features and advantages of the invention will be apparent from the following more particular description of preferred embodiments of the invention, as illustrated in the accompanying drawings. The drawings are schematic and not necessarily to scale, emphasis instead being placed upon illustrating principles of the invention.

DESCRIPTION OF THE PREFERRED EMBODIMENTS

Figure 1:
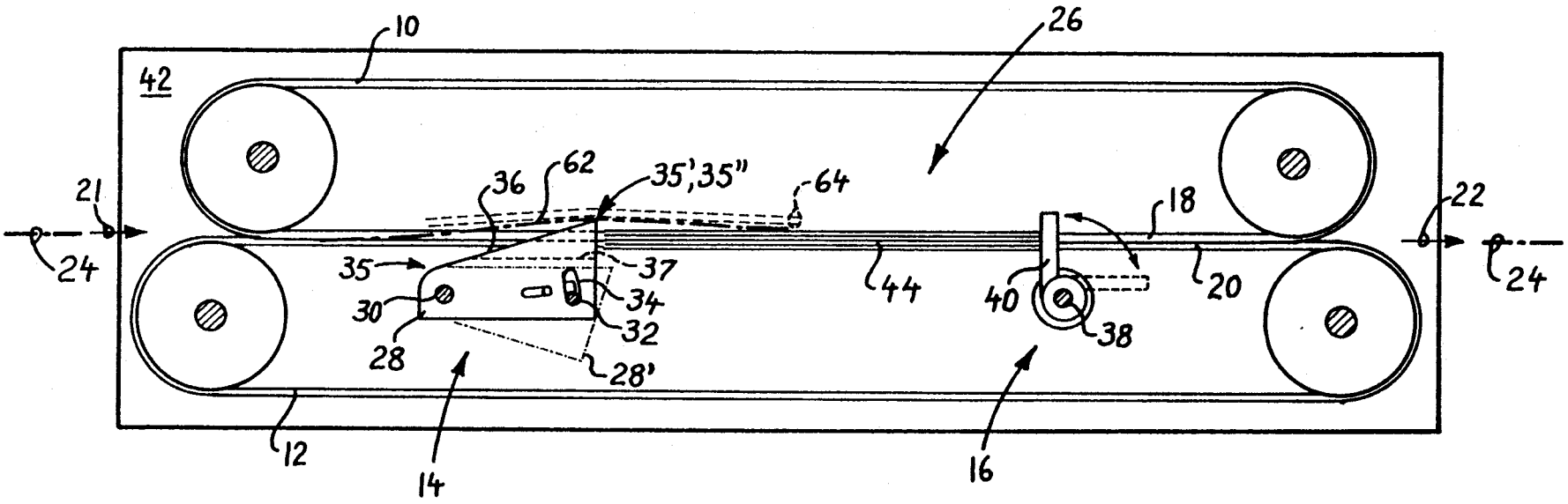
FIG. 1 is a schematic side elevational view of a retractable-ramp accumulator according to the invention.

Referring now to the drawing of FIG. 1, there is shown an embodiment of the present invention comprising sheet feeding means in form of driven upper endless elastic belts 10 and driven lower endless elastic belts 12, retractable-ramp means 14, and stop gate means 16.

Upper belts 10 include lower reaches 18 and lower belts 12 include upper reaches 20. Belts 10 and 12 are driven so that reaches 18 and 20 move at substantially the same speed in a common direction from left to right; as also indicated by direction arrows 21 and 22. Reaches 18 and 20 are substantially disposed in and thereby define a generally horizontal feeding plane 24 defining a first and a second side (thereabove and beneath). A stacking region 26 (including means for stacking) is disposed between and along reaches 18 and 20 substantially in and parallel to feeding plane 24.

Selectively retractable ramp means 14 is disposed upstream from stacking region 26 and comprises at least one interposer 28 mounted pivotably about the axis of shaft 30. The interposer 28 is further supported by a stationary boss 32 that extends through an arcuate slot 34 (in the interposer). Interposer 28 further includes an arresting mechanism for locking the interposer selectively in the interposed position or orientation (shown by solid lines) or in a retracted position or orientation indicated by phantom outline 28'. The arresting mechanism will be discussed in detail in conjunction with FIGS. 3 and 4.

Interposer 28 includes a leading end 35, a trailing end 35' having a step edge 35", and a deflection ramp face 36. Interposer 28 includes a clearance slot 37 within which a length of lower reach 18 is disposed while the interposer is disposed in its interposed position. It is to be understood that the interposer 28, while in its interposed position, extends across feeding plane 24 (as shown). The interposer 28, while in its retracted position (indicated by phantom outline 28'), is disposed extraplanarly in relation to feeding plane 24.

Stop gate means 16 (included in stacking region 26) comprises an axle 38 and stop member 40 mounted on axle 38. Axle 38 (and therewith member 40) is selectively rotatable into one of two positions, for instance manually, by electric motor means, or by means of a rotary solenoid. In the position shown by solid lines, stop member 40 extends across the feeding plane 24. In the position indicated by dashed lines, stop member 40 is positioned beneath the feeding plane 24.

The shafts for the pulleys of belts 10 and 12 are born in a frame structure schematically indicated here by the numeral 42. Similarly, shaft 30, boss 32, and axle 38 are supported by frame structure 42.

A stack 44 of accumulated sheets is shown in FIG. 1 in stacking region 26. Although belts 10 and 12 are driven continuously with reaches 18 and 20 moving from left to right, the sheets in stack 44 are stopped with their leading edges in registration against stop member 40. It should be understood that stack 44 is disposed between lower and upper reaches 18 and 20, the reaches being disposed in different interlaced transverse locations and being vertically slightly interlaced, as customary in sheet conveying between belts. Consequently, stack 44 and any conveyed sheets are transverselly slightly corrugated in wave-like manner; hence the stack does not appear to be located between the reaches 18 and 20 in the depicted view.

Figure 2:
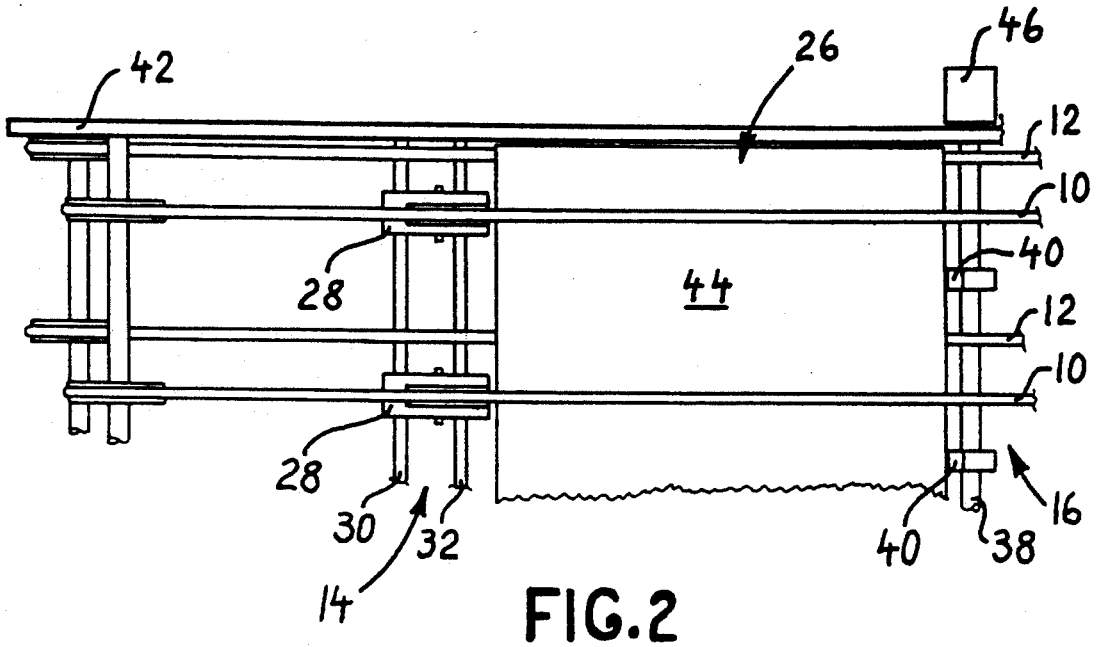
FIGS. 2 is a schematic fragmental top view of a portion of the accumulator shown in FIG. 1.

Referring now more particularly to FIG. 2, depicted therein is a reduced-size partial top view of the accumulator shown in FIG. 1. A motor 46 is shown in stop gate means 16. For instance, motor 46 can be an electric motor or a rotary solenoid for selectively rotating stop member 40 from one to the other of its positions (indicated in FIG. 1).

Figure 3:
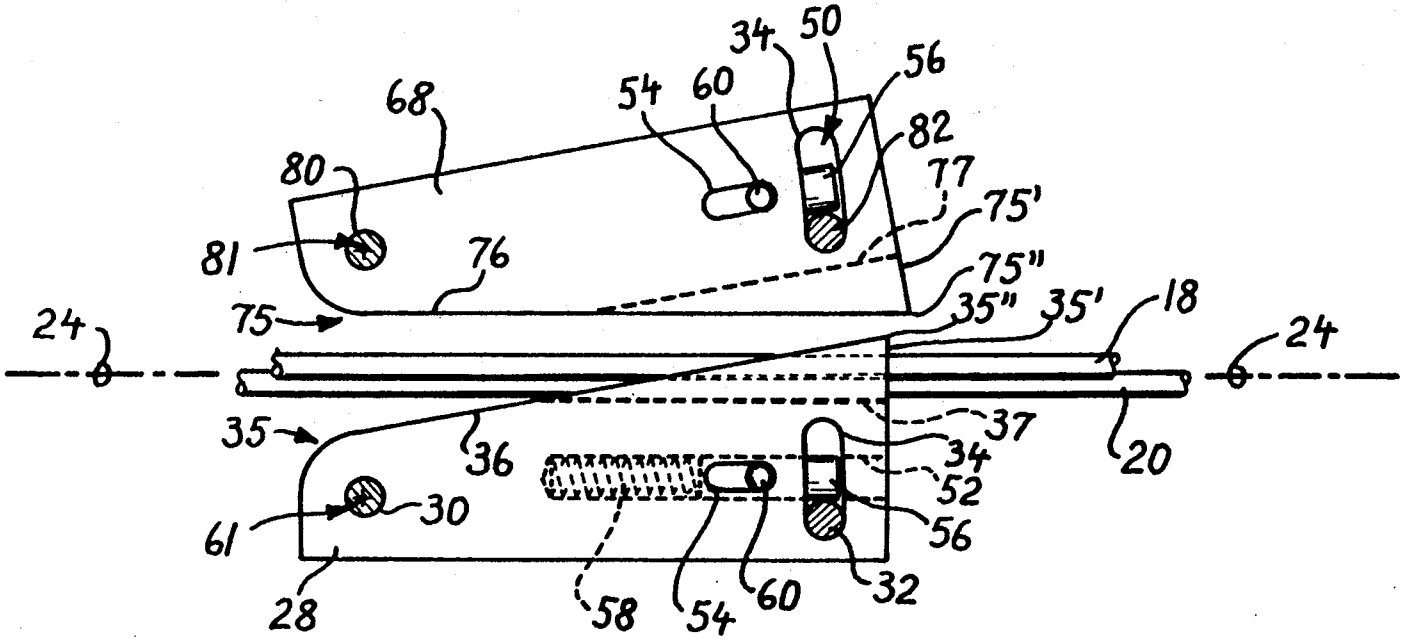
FIG. 3 is an enlarged fragmental side view of a retractable ramp arrangement of the invention; and, FIG. 4 is a enlarged schematic end view of a retractable ramp also shown in FIGS. 1–3.

Referring now to FIG. 3, shown enlarged in the lower portion thereof is shown interposer 28 including arresting mechanism 50. Interposer 28 includes a blind bore 52 that extends from the face of trailing end 35' across and through arcuate slot 34 and farther for some depth past a stop slot 54. Arresting mechanism 50 includes an arresting pin 56 that is slidably disposed in bore 52 against a compressed compression spring 58. The arresting pin 56 is retained in bore 52 by a retraction pin 60 that is retained in a crosshole in arresting pin 56 and that extends through stop slot 54 and protrudes beyond the sides of interposer 28 (as for instance shown in FIG. 4. Arresting pin 56 has such a length that it extends past boss 32 when pin 56 (and pin 60) is in the position shown.

Interposer 28 is born upon shaft 30 pivotably about the axis 61 (of shaft 30). Interposer 28 is further supported by boss 32 that extends through arcuate slot 34 in such a manner that the pivoting motion of interposer 28 about axis 61 is limited by boss 32 within the arcuate length of slot 34. Shaft 30 and boss 32 are mounted in the accumulator frame structure 42 shown in FIGS. 1 and 2. The action of arresting pin 56 engages and holds boss 32 selectively at one or the other end of arcuate slot 34 and thusly arrests interposer 28 selectively in one of two orientations or positions, namely in the interposed position shown here or in the retracted position 28' indicated in FIG. 1.

In use of the arresting mechanism, retraction pin 60 is urged along stop slot 54 agaist compression spring 58 until arresting pin 56 clears arcuate slot 34 and interposer 28 can be pivoted into the retracted position. Compression spring 58 returns arresting pin 56 to engage and hold boss 32 upon release of retraction pin 60 and thusly arrests interposer 28 in the new position.

Figure 4:
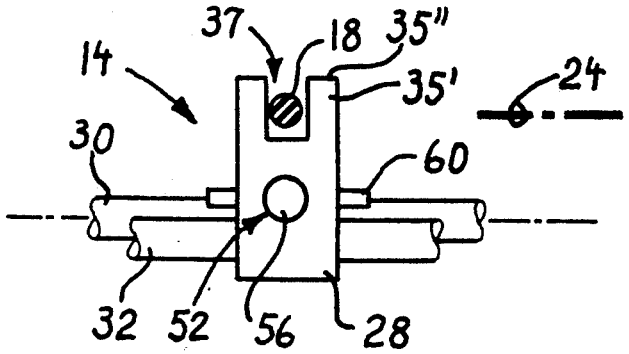

Referring now to FIG. 4, details of retractable ramp means 14 are shown in a fragmental end view (viewed in upstream direction). Interposer 28 is shown in its interposed position interposed across feeding plane 24; in this position, lower reach 18 of belt 10 passes through clearance slot 37. Interposer 28 is pivotably supported by shaft 30 and is further supported, in selectively arrestable manner, by boss 32 in either one of the interposed (here shown) or retracted positions. The shown arresting pin 56 and retraction pin 60 are components of the arresting mechanism 50 which has been discussed in the foregoing in conjunction with FIG. 3.

Referring now particularly to FIGS. 1, 2, and 4, in operation of the illustrated embodiment, singulated sheets are fed seriatim in direction of arrow 21 substantially in feeding plane 24 between lower and upper reaches 18 and 20, respectively, of respective belts 10 and 12. A sheet is intercepted by interposer 28 and deflected along deflection ramp face 36 out of the feeding plane 24 over step edge 35", as indicated by deflected sheet 62 (phantom line). Lower reach 18 is thereby also diverted over step edge 35", being in contact with and disposed above sheet 662 in the location of interposer 28. This diverted position of lower reach 18 is indicated in dashed lines lines by diverted reach 64. Downstream of step edge 35" and trailing end 35', the deflected sheet 62 is urged back toward feeding plane 24 by the resilient action of diverted reach 64. Sheet 62 is selectively stoppable in stacking region 26 by stop member 40.

If a sheet is present in stacking region 26 (stopped therein), deflected sheet 62 is urged over and onto such a stopped sheet, and is thusly stacked in stack 44. When stop member 40 is rotated out of the way, stack 44 is released to be fed between reaches 18 and 20 in and along feeding plane 24 in direction of arrow 22. The operation need not limit itself to stacking of numbers of sheets, but can be selectively utilized to stage individual sheets; i.e. a single sheet can be selectively stopped and released by stopping means 16, for example to adjust delivery of the sheet to timing requirements of further equipment.

In operation of this embodiment, when interposer 28 is retracted into position 28', singulated sheets are fed undeflected in feeding plane 24 past the interposer and through the accumulator to further equipment. Alternately, individual sheets can selectively be stopped and released by stopping means 16, for example also to stage and adapt delivery of the sheets to timing requirements of further equipment.

Referring now to FIG. 3 (in conjunction with FIGS. 1 and 4), shown thereby is another embodiment that employs at least one interposer mounted and supported on each side of feeding plane 24, namely interposers 28 and 68. Interposer 28 is the same as depicted in FIG. 1 (and in the lower portion of FIG. 3 and in FIG. 4)) and described in conjunction therewith. The interposers 28 and 68 have identical structures, but those mounted on one side of feeding plane 24 are laterally offset with respect to the ones mounted on the other side of feeding plane 24. For example, as illustrated, the interposer 28, mounted beneath feeding plane 24, is disposed in the same vertical plane as lower reach 18 (the same as in the embodiment of FIG. 1), and the interposer 68, mounted above feeding plane 24, is disposed in the same vertical plane as upper reach 20. Just like interposer 28, interposer 68 is also selectively interposable across and retractable out of the feeding plane.

Interposer 68 includes components that are identical in structure and function to those of interposer 28. Thus, interposer 68 comprises an arresting mechanism 50 including: a bore 52 (not specifically shown here), an arcuate slot 34, a stop slot 54, an arresting pin 56, a compression spring 58 (not specifically shown here), and a retraction pin 60. Further, interposer 68 includes a leading end 75, a trailing end 75' having a step edge 75'', a deflection ramp face 76, and a clearance slot 77.

Selectively retractable (respectively interposable) interposer 68 is, just like interposer 28, also disposed upstream from stacking region 26. Interposer 68 is mounted on a shaft 80 pivotably about the shaft's axis 81. Interposer 68 is further supported by a stationary boss 82 that extends through arcuate slot 34 and that is locked selectively in one of two end positions in slot 34 corresponding to the retracted and interposed positions of the interposer 68. Interposer 68 is shown in FIG. 3 in retracted position; its interposed position is analogous to the interposed position shown for interposer 28, except that interposer 68 is interposed downwardly across feeding plane 24. As shown in retracted position, interposer 68 is disposed extraplanarly in relation to feeding plane 24.

While interposers 68 are disposed in retracted position, the operation of the embodiment including interposers 68 and 28 (shown particularly in FIG. 3) and discussed in the foregoing in conjunction with FIGS. 3 and 1, is identical to the operation of the embodiment that includes only interposers 28 and that has been described in the foregoing particularly in conjunction with FIGS. 1, 2, and 4. Similarly, while interposers 28 are disposed in retracted position, the operation of the embodiment including interposers 68 and 28 is analogous to the operation of the embodiment including only interposers 28, except that the accumulation mode is reversed. In other words, while interposers 28 are disposed in retracted position, "under" accumulation can be performed (by interposers 68 in interposed position); and, while interposers 68 are disposed in retracted position, "over" accumulation can be performed (by interposers 28 in interposed position).

In a preferred mode of operation, interposers 28 and 68 have mutually exclusive interposed and retracted positions, such that "over" or "under" accumulation can be selectively chosen. When the option of staging of individual sheets is desired (or a simple passing-through the accumulator of sheets to further equipment) rather than the stacking of sheets, both interposers 28 and 68 are arrested in their retracted positions.

It should be understood that interposers 28 and 68 can be selectively positioned (to interposed or retracted positions) by remotely actuatable electrical motor means not shown here. It should be also understood that relative distances (along feeding plane 24) between stop gate means 16 and interposers 28 and 68 can be adjustable to adapt an accumulator to stack different size sheet material. In this respect, such adjustability can be provided by manual repositioning means or alternately (and/or additionally) by remotely actuatable electric motor means here not shown.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. An accumulator for sheet material, comprising:

means for feeding singulated sheets in seriatim, said means for feeding having a feeding plane in which the singulated sheets are fed at least through portions of said accumulator, said feeding plane having a first and a second side;

means for selectively accumulating singulated sheets, comprising:

means for stacking sheets, said means for stacking being disposed substantially along said feeding plane and including means for selectively stopping sheets from being fed farther by said means for feeding; and, ramp means for selectively intercepting singulated sheets, said ramp means being disposed substantially along said means for feeding upstream from said means for stacking, said ramp means including at least one interposer, said interposer having an interposed and a retracted position and being selectively respectively interposable and retractable thereinto, said interposer being disposed substantially extraplanarly in relation to said feeding plane while disposed in said retracted position and extending across said feeding plane while disposed in said interposed position;

wherein said interposer, while disposed in said interposed position, is operative in deflecting the singulated sheets out of said feeding plane, said means for feeding being operative in urging the deflected singulated sheets downstream from said interposer back toward said feeding plane;

said interposer, while disposed in said retracted position, being inoperative in deflecting the singulated sheets and comprising:

a leading end;

a trailing end having an edge; and, a deflection ramp face;

said leading end being disposed on one of said sides of said feeding plane, said deflection ramp face extending from said leading end across said feeding plane to the other of said sides thereof while said interposer is disposed in said interposed position; and, said deflection ramp face being disposed substantially on said one of said sides of said feeding plane while said interposer is disposed in said retracted position;

whereby, while said interposer is disposed in said interposed position, the singulated sheet is deflected to the other of said sides of said feeding plane by said deflection ramp face out of said feeding plane over said edge and is thereafter urged by said means for feeding toward said one of said sides of said feeding plane onto prior sheets that have been stopped by said means for selectively stopping.

2. The accumulator according to claim 1, wherein said ramp means further comprises means for mounting said interposer in selectively reorientable manner, said means for mounting including:

means for pivoting said interposer, said means for pivoting having a fixed pivot axis for pivoting and thereby reorienting said interposer thereabout, said pivot axis being oriented substantially transverselly with respect to the feeding direction of said means for feeding and being disposed extraplanarly in relation to said feeding plane and substantially parallel thereto; and, means for arresting said interposer selectively respectively in said interposed and retracted positions, said interposed and retracted positions corresponding to respective orientations of said interposer about said pivot axis.

3. The accumulator of claim 1, wherein said ramp means further comprises means for mounting said interposer in selectively reorientable manner, said means for mounting including:

means for pivoting said interposer, said means for pivoting having a fixed pivot axis for pivoting and thereby reorienting said interposer thereabout, said pivot axis being oriented substantially transverselly with respect to the feeding direction of said means for feeding and being disposed extraplanarly in relation to said feeding plane and substantially parallel thereto, said pivot axis extending through said interposer proximally to said leading end; and, means for arresting said interposer selectively respectively in said interposed and retracted positions, said interposed and retracted positions corresponding to respective orientations of said interposer about said pivot axis.

4. The accumulator according to claim 1, including first and second interposers having mutually exclusive said interposed and said retracted positions, respectively, so that said second interposer is disposed in said retracted position while said first interposer is disposed in said interposed position, and so that said first interposer is disposed in said retracted position while said second interposer is disposed in said interposed position, respectively.

5. The accumulator of claim 4, wherein said first interposer is disposed substantially on the one of said sides while in said retracted position, and wherein said second interposer is disposed substantially on the other of said sides while in said retracted position.

6. A method of selectively accumulating singulated sheet material in an accumulator, comprising the steps of:

(a) feeding singulated sheets in said accumulator at least through portions thereof in a feeding plane;

(b) selectively interposing and retracting first and second interposers across and out of said feeding plane, respectively;

(c) intercepting and deflecting the singulated sheets out of said feeding plane while said first interposer is interposed across said feeding plane;

(d) urging the singulated sheets that are being deflected during the step (c) back toward said feeding plane in a stacking region downstream from said first interposer;

(e) undeflectedly feeding singulated sheets in said feeding plane past said first interposer while said first interposer is retracted out of said feeding plane; and, (f) selectively stopping the singulated sheets in said stacking region along said feeding plane; and, wherein said step (b) comprises the step of mutually exclusively interposing and retracting said first and said second interposers, respectively;

so that said second interposer is being retracted out of said feeding plane while said first interposer is being interposed across said feeding plane, and so that said first interposer is being retracted out of said feeding plane while said second interposer is being interposed across said feeding plane.

7. The method according to claim 6, wherein the step (b) includes the steps of:

reorienting said first interposer by pivoting about a fixed pivot axis; and, arresting said first interposer in orientations corresponding to said first interposer being interposed and retracted across and out of said feeding plane, respectively.

8. The method of claim 6, wherein said feeding plane has a first and a second side, and wherein the step of mutually exclusively interposing and retracting is effected by:

interposing said first interposer across said feeding plane and retracting said first interposer out of said feeding plane to the one of said sides, respectively; and, retracting said second interposer out of said feeding plane to the other of said sides and interposing said second interposer across said feeding plane, respectively.

* * * * *